United States Patent [19]

Hoofe, III

[11] Patent Number: 4,598,522

[45] Date of Patent: Jul. 8, 1986

[54] INTERLOCKING PANELS

[76] Inventor: William J. Hoofe, III, 1973 Port Provence, Newport Beach, Calif. 92660

[21] Appl. No.: 623,832

[22] Filed: Jun. 22, 1984

[51] Int. Cl.[4] ..... E04D 1/08

[52] U.S. Cl. ..... 52/555

[58] Field of Search ..... 52/553, 555, 588, 589, 52/313, 314, 539, 560, 527, 478; 428/215, 421

[56] References Cited

U.S. PATENT DOCUMENTS

| | | | |
|---|---|---|---|
| 1,538,549 | 5/1925 | Hahn | 52/314 |
| 2,612,246 | 9/1952 | Whitehouse et al. | 52/539 |
| 2,820,257 | 1/1958 | Newton | 52/553 |
| 3,228,823 | 1/1966 | Usala et al. | 428/421 |
| 3,265,823 | 8/1966 | Hungerford et al. | 428/215 |
| 3,421,973 | 1/1969 | Kamal et al. | 428/215 |
| 3,605,369 | 9/1971 | Merrill et al. | 52/560 |
| 3,726,754 | 4/1973 | Coglianese et al. | 428/215 |
| 4,034,528 | 7/1977 | Sanders et al. | 52/527 |

*Primary Examiner*—James L. Ridgill, Jr.

*Attorney, Agent, or Firm*—Blakely, Sokoloff, Taylor & Zafman

[57] ABSTRACT

Various forms of interlocking weatherproof roofing and siding panels are disclosed. The panels each comprise a background sheet of relatively thin material, in which are integrally formed one or more raised decorative elements such as simulated tile or shake elements. At the front or lower edge of each panel at least some of the decorative elements have a sunken or indented area integrally formed in the face thereof, with the rear or upper portion of each decorative element having a cooperatively disposed integrally formed protruding element. During installation, after a starter course is installed each panel of each successive course is retained in position at the front thereof by the interlocking of the protruding regions on at least some of the decorative elements thereon with the sunken region of the next lower course, and at the rear thereof by nails or staples passed through a nailing flange provided for that purpose, the fasteners being covered by the lower portion of the next higher course to provide an interlocking weatherproof system with hidden fasteners. The sunken regions and the protruding regions on the decorative elements are specifically limited in lateral extent to significantly less than the width of the front and back of the decorative elements to avoid any intersections between the edges of the decorative elements and the interlockers. Also, preferably the sunken regions and the protruding regions are gradual in lateral extent. These, plus other features of the panels, facilitate the manufacture thereof by injection molding or relatively low cost vacuum forming techniques by distributing material stretch during forming and avoiding excessive concentrated stretch in local areas. Various embodiments are disclosed.

51 Claims, 15 Drawing Figures

5

5

Fig. 5
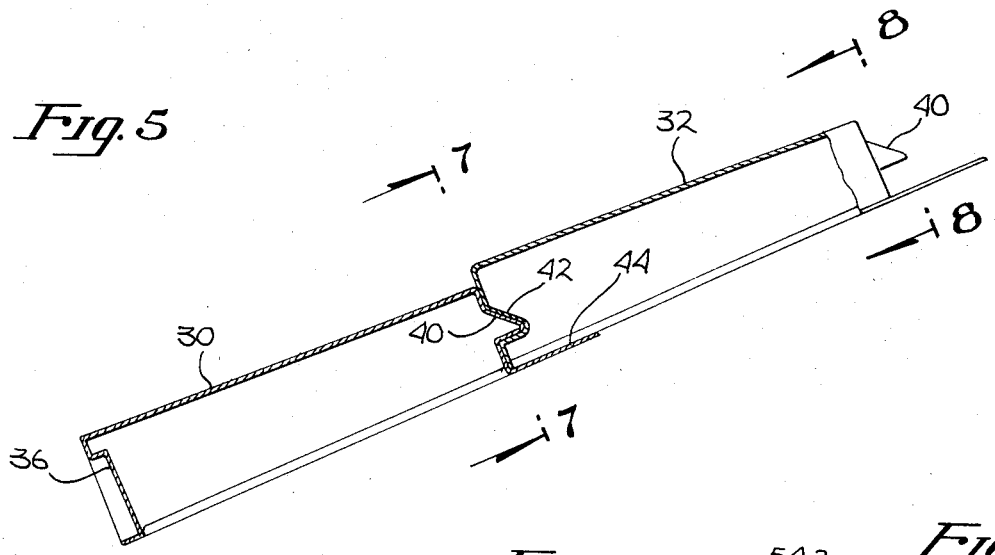
Fig. 6
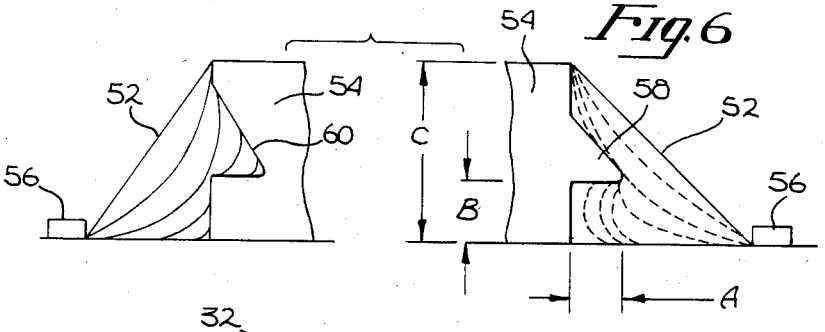
Fig. 9
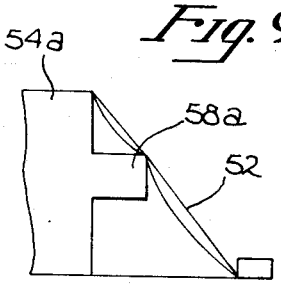
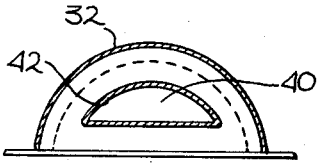
Fig. 7
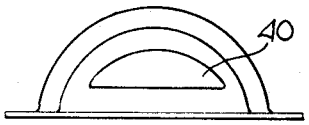
Fig. 8
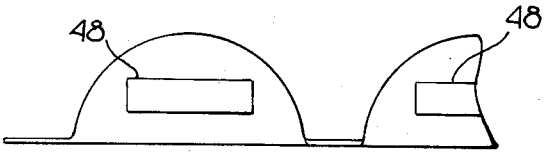
Fig. 10
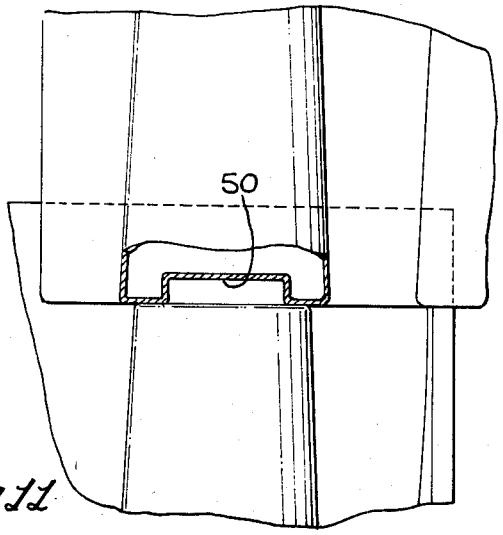
Fig. 11

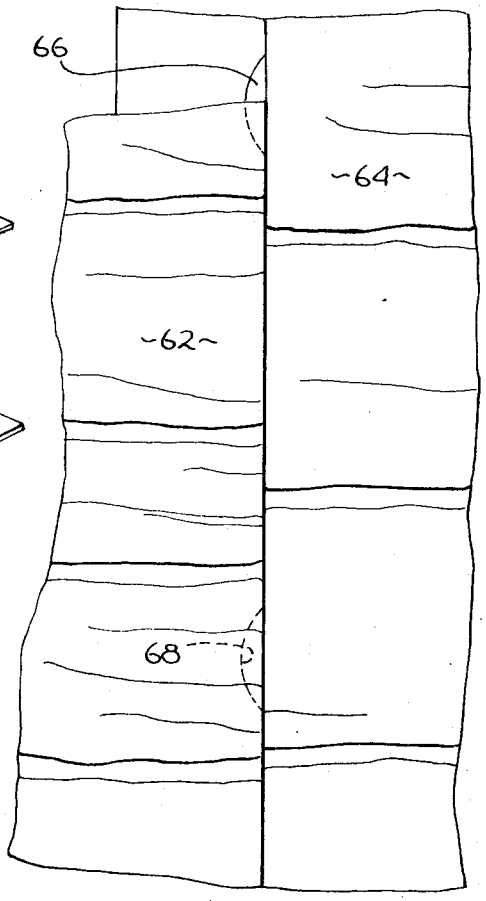
Fig. 13
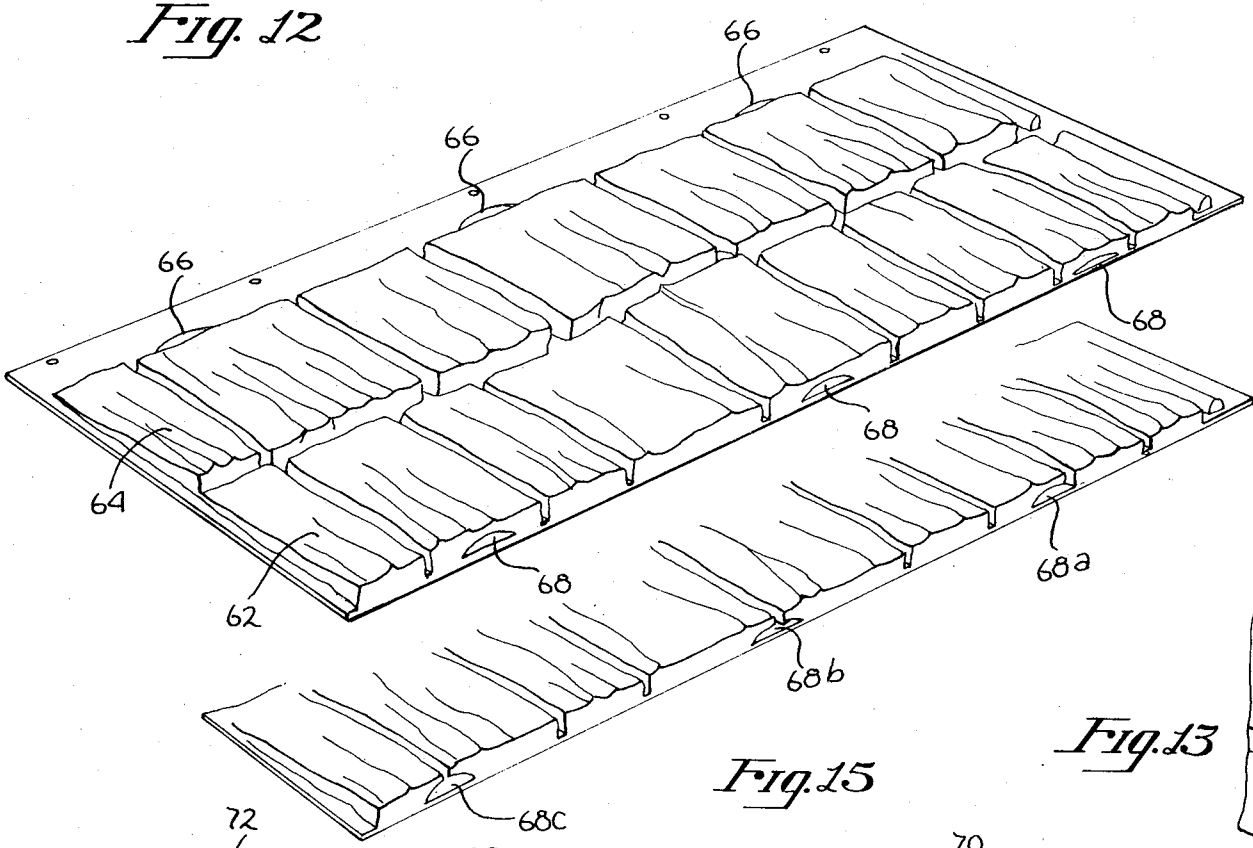
Fig. 12
Fig. 15
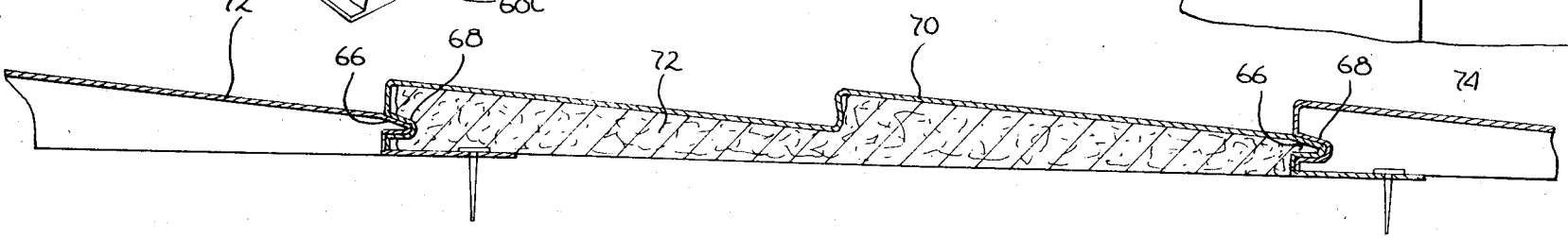
Fig. 14

INTERLOCKING PANELS

BACKGROUND OF THE INVENTION

1. Field of the Invention

The present invention relates to the field of roofing and siding materials, and in particular, to interlocking decorative roofing and siding panels.

2. Description of Prior Art

The present inventor has manufactured various types of simulated roofing panels and roofing panel systems utilizing thermoplastic sheet and vacuum forming processes for a number of years. Such panels typically have simulated either Spanish tile or wood shake roofing, though the general materials and techniques may be used, and in many cases have been used, to simulate other roof coverings such as Chinese tile or coverings having an aesthetic appearance unlike that of any of the historically conventional roofing materials. By way of example, the present inventor has manufactured simulated Spanish tile non-interlocking panels in accordance with U.S. Pat. No. 3,485,002. The present inventor has also manufactured simulated shake panels, particularly of a non-interlocking panel design, having an ornamental appearance generally in accordance with U.S. Pat. No. 4,343,126. Non-interlocking panels of this general type are generally used for mansards and indoor decorative purposes, but are not frequently used for roof area coverage because of the fact that they require exposed fasteners.

Interlocking shake and tile panels are disclosed in U.S. Pat. Nos. 4,343,126 and 4,251,967, respectively. In the case of the first of these patents, the top of the nailing flange of each panel is doubled back onto the lower part of the nailing flange to provide a downward facing slot or hook to engage the front edge of the panel in the next higher course, which front edge is bent under the panel for this purpose. The nailing flange is of course still used to fasten the rear of each panel to a roof by nailing or stapling through the double thickness flange, with the front of each panel being retained by the engagement of the front lip with the hook formed by the nailing flange. While this system works well, manufacture of the panel requires that the bending of the front lip under the panel and the bending of the nailing flange into the downward facing U-shape generally be done as secondary operations to the vacuum forming operation, particularly after the trimming subsequent to vacuum forming. Further, while installation is much faster than with conventional shake, care must be taken and some delay is encountered in obtaining and being sure of proper engagement of vertically adjacent panels on a roof.

The foregoing problems are overcome by the interlocking panels of U.S. Pat. No 4,251,967. In particular, that patent discloses an interlocker comprising a slot or channel typically running all the way across the lower part of the back of the decorative element in a simulated tile or shake panel so as to form a discontinuous slot across the width of the back of the panel. The front of each panel has a cooperatively disposed lip-like region which engages the channel at the back of a panel so that the panels quickly slip together during installation to minimize installation time. Further, by using an appropriate vacuum forming mold, the vacuum forming of the entire panel including the interlockers may be done in a single step, thereby minimizing secondary operations in the manufacturing process. However, the vacuum formed sheet thins out substantially in the corner regions of the intersection of the slot at the back of the panel and the edges of the decorative elements, particularly in the outward projecting corners thereof at the rear of the decorative element. This effect may be readily minimized with simulated tile panels if the panels overlap each other, as illustrated with the primary embodiment of that patent, by providing a generous radius on the corresponding corners of the decorative elements. Similar techniques may also used in the corresponding regions of simulated shake panels, though the extent of the rounding of the corners which can be used is perhaps more limited than with the tile panels if the rounding is not to effect the visual appearance of the installed roof. Obviously such thinning during the vacuum forming process would be non-existent if the product were injection molded rather than vacuum formed. Even in such case, the extension of the discontinuous slot entirely across the back of a decorative element may still effect the visual appearance of the finished roof. The slot shown in that patent cannot be terminated short of the edges of each decorative element, however, as to do so would create a water trap, with freezing of the trapped water possibly cracking or loosening the panels.

SUMMARY OF THE INVENTION

Various forms of interlocking weatherproof roofing and siding panels are disclosed. The panels each comprise a background sheet of relatively thin material, in which are integrally formed one or more raised decorative elements such as simulated tile or shake elements. At the front of each panel at least some of the decorative elements have a depression integrally formed in the face thereof, with the rear of at least one decorative element having a cooperatively disposed integrally formed protruding element. During installation, after a starter course is installed, each panel of each successive course is retained in position at the front thereof by the interlocking of the depressions on at least some of the decorative elements thereon with the protrusions at the rear of the next lower course of panels, and at the rear thereof by nails or staples passed through a nailing flange provided for that purpose, the fasteners being covered by the lower portion of the next higher course to provide an interlocking weatherproof system with hidden fasteners. The sunken regions and the protruding regions on the decorative elements are specifically limited in lateral extent to significantly less than the width of the front and back of the decorative elements to avoid any intersections between the edges of the decorative elements and the interlockers. Also, preferably the sunken regions and the protruding regions are gradual in lateral extent. These, plus other features of the panels, facilitate the manufacture thereof by injection molding or relatively low cost vacuum forming techniques by distributing material stretch during forming and avoiding excessive concentrated stretch in local areas. Various embodiments are disclosed.

BRIEF DESCRIPTION OF THE DRAWINGS

FIG. 5 is a cross section taken along line 5—5 of FIG. 4.

FIG. 6 is a schematic diagram illustrating the stretching of a thermoplastic material during vacuum forming of panels in accordance with FIGS. 1 through 5.

FIG. 7 is a cross section taken along line 7—7 of FIG. 5.

FIG. 8 is a view taken along line 8—8 of FIG. 5.

FIG. 9 is a schematic illustration of an alternate form of protrusion at the back of tile panels of the present invention.

FIGS. 10 and 11 are views of panels in accordance with FIG. 9, corresponding to FIGS. 7 and 8 for the earlier described embodiment.

FIG. 11 is a top view of two panels in adjacent courses, partially cut away to show the engagement of the adjacent panels of this alternate embodiment.

FIG. 12 is a perspective view of a further alternate embodiment comprising a double course simulated shake panel.

FIG. 13 is a top view of a portion of two panels in adjacent courses illustrating the staggered interlocking thereof.

FIG. 14 is a cross section of three courses of panels illustrating the use of a foam insulator and structural support therein.

FIG. 15 is a perspective view of the front of a panel similar to that of FIG. 12, illustrating the overlap of the depressions at the front of the panel overlapping two adjacent decorative elements.

DETAILED DESCRIPTION OF THE INVENTION

Figure 1:
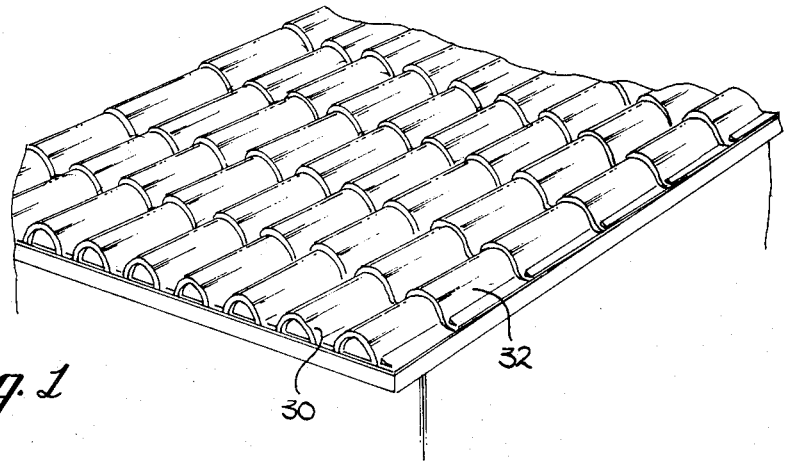
FIG. 1 is perspective view of a portion of a roof illustrating a typical installation with simulated tile panels in accordance with the present invention.

First referring to FIG. 1, a perspective view of a portion of a roof covered with one embodiment of roofing panels of the present invention may be seen. In a typical installation a starter course of panels 30 will be fastened down along the lower edge of the roof, with the front of the next course of panels 32 interlocking with the back of panels 30 and covering the fasteners passing through the nailing flange thereof in a manner to be described. Each successive panel after the starter course is held in position at the front thereof by the interlocking of the front portion of the decorative elements thereon with the back of the decorative elements on the next lower course of panels, and at the rear thereof by nailing or stapling through the nailing flange provided for that purpose. The specific embodiment illustrated in FIG. 1 simulates a Spanish roofing tile, though as shall subsequently be seen, the present invention is not so limited, but may be readily applied to roofing panels simulating other forms of roof covering such as other tile, wood shake, etc.

Figure 2:
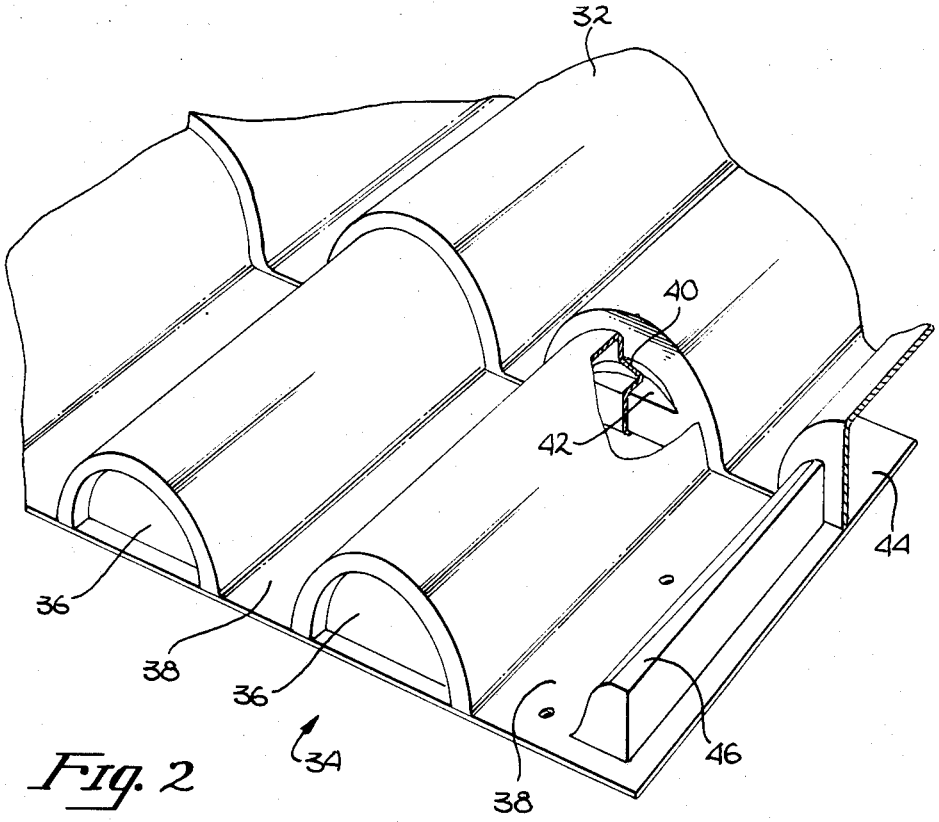
FIG. 2 is a view taken on an expanded scale of the right hand portion of one panel partially cut away to illustrate the engagement thereof with the next adjacent panel in an upper course of panels.

Now turning to FIG. 2, a portion of the installed roof of FIG. 1 partially cut away to illustrate the interlock of the present invention may be seen. The lower panel, generally indicated by the numeral 34, is typical of a panel in the starter course, in that it has a lower face region 36 simulating the face or edge of a real tile roof, being nailed or stapled to the roof through the regions 38 between the simulated tile members. The next panel 32, of course, is representative of the panels in any of the subsequent courses proceeding up the roof to the peak. In the embodiment illustrated, each panel simulates one course of tile so that the number of courses of panels is equal to the number of courses of tile. However it is to be understood that a single panel, whether simulating tile or shake or any other roof cover, may readily be manufactured to simulate more than one course of the tile, shake, etc., as desired.

As is suggested in FIG. 2, panels in each course of panels are provided with an integrally formed protrusion 40 at the back of at least some of the decorative elements on each panel. Also panels 32 in each course other than the first course have cooperatively disposed and integrally formed depressions 42 in the front of at least some of the decorative elements, so that the protrusions 40 at the rear of one course of panels, after being fastened down through the nailing flange thereof, may engage the depressions 42 at the front of the panels in the next higher course to prevent the front of the panels from lifting in a wind.

In the embodiment illustrated in FIG. 2, it will be seen that the protrusion 40 and the depression 42 each have a width which is less than the width of the decorative element on which they are formed and integral with. This is an important aspect of the present invention as it eliminates the need for any intersection of the protrusion and depression with the adjacent edges of the respective decorative element. Thus, since it was this intersection where excessive thinning of the material was found to sometimes occur in vacuum formed panels in the past, the elimination of this intersection effectively eliminates the excessive thinning also. Further, it may be seen from FIG. 2 that the protrusion 40 and the depression 42 are not localized in lateral extent, that is, are not rectangular protrusions and depressions having parallel sidewalls, but rather are protrusions and depressions which, going across the back and front of a decorative element respectively, gradually diverge from the wall of the decorative element to a maximum and then gradually recede back. This, too, is an important aspect of the present invention, as it also helps minimize localized thinning of the thermoplastic sheet during vacuum forming. Both of these aspects will be subsequently discussed in greater detail. Even in an injection molded product, the termination of the protrusions and depressions short of the edges of the decorative elements in this manner facilitates mold filling without affecting the appearance of the installed roof or creating a water trap of any kind.

Figure 3:
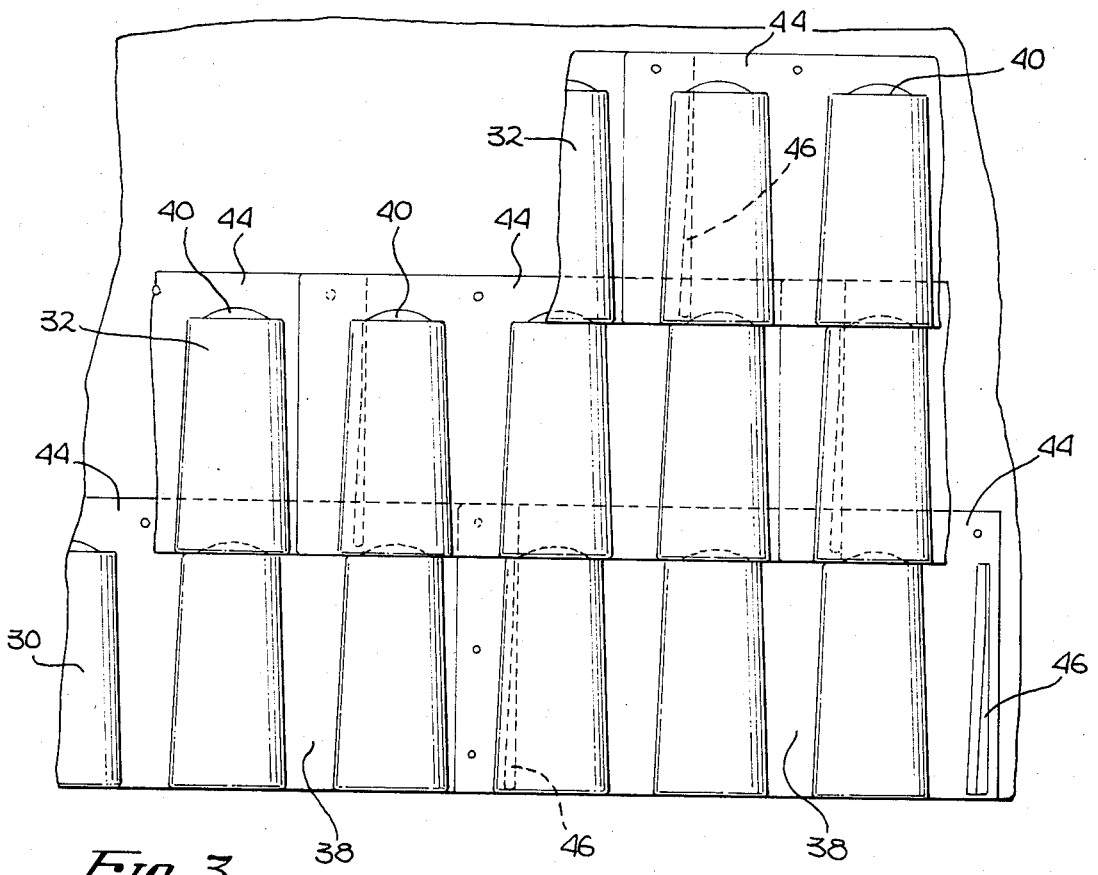
FIG. 3 is a top view of a portion of the installation of FIG. 1 partially cut away and illustrating in phantom the engagement of adjacent panels.
Figure 4:
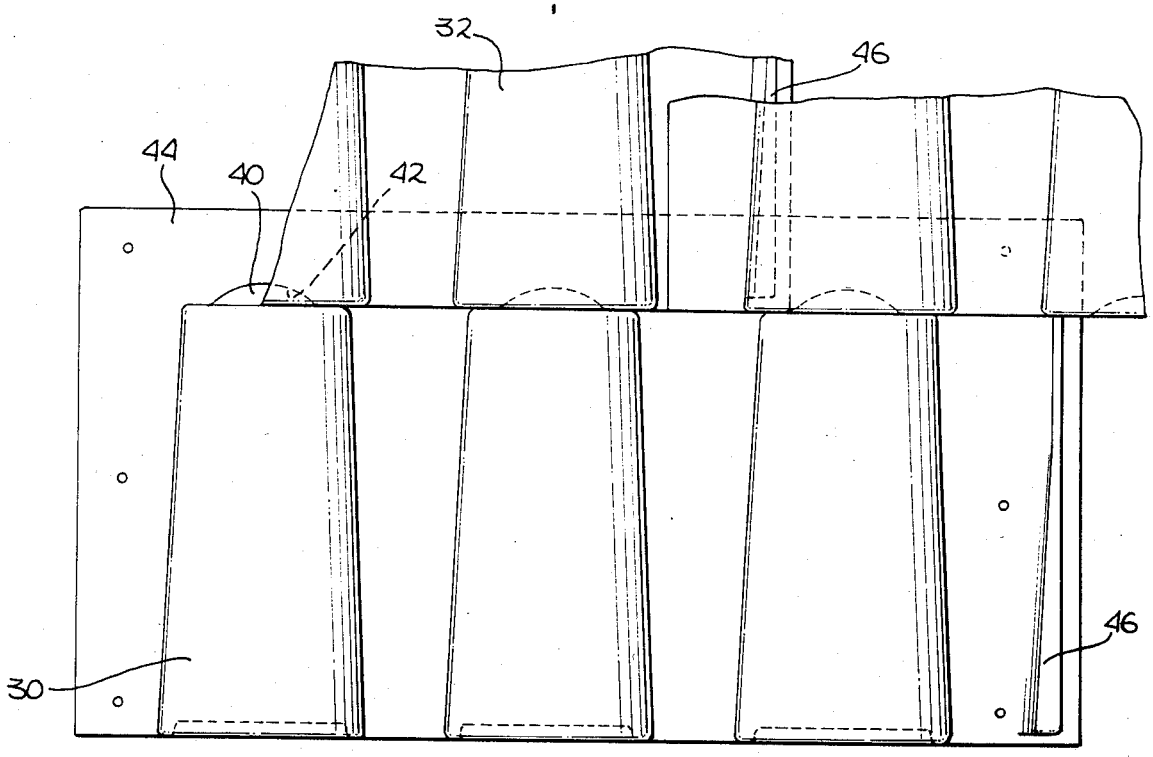
FIG. 4 is a view similar to that of FIG. 3 taken on an expanded scale.

Now referring to FIGS. 3 and 4, a top view of a portion of the roof illustrated in FIG. 1 and showing certain aspects of the panels of the present invention may be seen. FIG. 3 illustrates a portion of a first course of panels 30 and a portion of second and third courses of panels 32, whereas FIG. 4, taken on an expanded scale, merely includes a panel 30 of the first course and portions of two panels 32 of the second course. The starter course is fastened to the roof through the regions between decorative elements. As may be seen, each panel in both the starter course and in successive courses has a rear nailing flange 44. The rear nailing flanges 44 serve not only as nailing flanges for nailing or stapling of the rear of the panels to the roof, but also in a finished installation extend upward under the front of the panels in the next course to provide a very effective moisture barrier therebetween, as also illustrated in the cross section of FIG. 5. In addition, each panel is configured so that adjacent panels in the same course will somewhat overlap, with a moisture barrier at the location of the overlap to prevent lateral seepage of water through the panel system. In particular as may be seen in FIG. 2, the region adjacent the right hand edge of each panel is formed as the complement 46 of the left portion of the left decorative element of each panel so that the left portion of each panel may overlap the right hand portion of the adjacent panel so that region 46 provides the desired nonvisible moisture barrier. In essence then, the roofing procedure would normally proceed from left to right and course to course going up the roof from eve to ridge.

Now referring to FIG. 6, a diagram illustrating the vacuum forming of a heated thermoplastic sheet 52 over a male mold 54 in accordance with the present invention may be seen. (Obviously a female mold may be used if desired, and in fact will yield a sharper pattern definition, depending on the mold.) In accordance with typical vacuum forming techniques, the thermoplastic sheet 52 is first placed in a form of frame 56 and heated. Thereafter, either the frame 56 is lowered over the mold 54 or alternatively the mold 54 is raised under the sheet to the position shown in FIG. 6, and a vacuum is drawn through small holes (not shown) in the mold 54 so that atmospheric pressure on the other side of the sheet forces the plastic sheet to conform to the mold shape. Obviously, for the mold shown the mold must be at least partially retractable or collapsible to remove the shaped sheet from the mold, though such molds are well known in the prior art and need not be illustrated in detail herein. Of particular importance to this disclosure, however, is the various shapes of the plastic sheet 52 as vacuum forming progresses. In particular, the protrusion is formed by the projection 58 on the mold. Provided there are no discontinuities or rapid changes in cross section of the projection 58, the heated thermoplastic sheet will deflect much like an elastic band would deflect. Thus, the plastic sheet will deflect as shown by the phantom lines in FIG. 6 until it conforms entirely to the mold shape. This will not be the case, however, if there are major discontinuities in cross sections adjacent to the cross section shown, as such discontinuities will cause very high and very localized material stretching in adjacent cross sections as well. It is for this reason that the cross sections of the recesses and protrusions taken in successive vertical planes through the respective decorative element are substantially free of discontinuities as the vertical plane of the cross section is moved across the recess or protrusion.

Stated another way, the protrusions and recesses start departing from the respective end of the decorative elements adjacent one side thereof, reaching a maximum departure adjacent the center thereof and then gently diminishing to no departure from the respective end of a decorative element at some point short of the other side thereof. This is to be compared with the illustration in FIGS. 10 and 11 wherein the recess 48 and protrusion 50 each are of substantially uniform cross section across most of the width of the respective end of the decorative element and then terminate with a substantial discontinuity. The form of protrusion and recess illustrated in FIGS. 10 and 11 functions properly in accordance with the present invention, as the intersection of the protrusions and recesses with the edges of the decorative element is still avoided, and may be readily fabricated by injection molding. With that configuration, however, the form of protrusions and recesses are not preferred for vacuum forming as they still cause more localized stretching than is required and have no special offsetting advantage. Also, it should be noted that while the embodiment illustrated with respect to FIGS. 1–4 has the protrusions and recesses totally terminate short of the edges of the decorative elements, this is not absolutely essential, as obviously a slight recess depth or protrusion height at the edges will only cause slight additional thinning and an insubstantial aesthetic effect in those regions, a normally tolerable situation. However, it should be noted that any such extension to the edges is substantially non-functional in terms of interlocking adjacent courses of panels together, as the maximum extent of the protrusion and recess must be quite substantial to assure a proper and safe interlocking of adjacent courses. In that regard, vacuum forming is a process of limited precision. Further, typical plastics have a relatively large coefficient of thermal expansion, typical panels have a course to course dimension on the order of one foot or more, and the temperature variation of the installed panels due to environmental changes could be on the order of 150° F. in some installations. Accordingly, the extent of the extension of the protrusions into the recesses must be quite substantial to provide adequate interlocking in the presence of all of the variables involved, and any continuation of such large protrusions and recesses to the side edges of the decorative elements clearly defeats the purposes of the present invention.

The extent of the projection required, represented by the dimension A in FIG. 6, will depend upon a number of factors such as the dimensional control on the finished parts, the repeatability in the engagement of adjacent panels during installation, and the size of the panels which will determine the amount of accumulated differential expansion between adjacent panels due to environmental extremes. In general, dimension A will be a predetermined required dimension for a particular panel size. Dimension B, on the other hand, may be chosen as desired within the bounds of the overall height C of the decorative element. Using a generally triangular shaped projection as shown in FIG. 5, it may be seen from FIG. 6 that the greatest stretching of sheet 52 occurs under the projection, which stretching would become particularly severe if the dimension B were small compared to dimension A. Going the other way, the larger the dimension B the less sheet 52 must stretch during the forming under the projection. At the front of the panel, however, the recess 60, generally complementary to the projection 58, creates just the opposite condition. In particular, obviously the depth of the recess must be substantially equal to the extent of the projection 58, and the recess itself must be filled with the portion of sheet 52 which initially covers the opening for the recess. Thus, the greater the dimension B the smaller this mouth of the recess is, effectively resulting in greater stretching to fill the recess. Consequently, as a compromise, the dimension B should be chosen on the order of one-half of dimension C. Actually for the tile panels shown, the tile decorative elements are of such a size that the dimension C is many times the dimension A, so that one may much more arbitrarily choose the dimension B, and may choose the dimension B substantially less than one-half C to locate the protrusion and recess in the lower, wider area of the simulated tile section. This is illustrated in FIGS. 7 and 8, showing the outline of a recess 42 and protrusion 40, respectively.

The protrusion and recess of FIGS. 2 through 5 is generally triangular shaped, with the bottom of the protrusion and recess being substantially parallel to the base plane of the panel. Obviously, other cross sections may also be used if desired, such as a rectangular cross section as illustrated in FIG. 9. Here the mold 54*a* has a projection 58*a* of rectangular cross section, as before gently varying in extent so as to not extend to the edges of the decorative element. Such a cross section is not preferred, however, for the reason that it results in considerable stretching and thinning of the sheet 52 above the protrusion for no particular reason, and actually results in a little more stretching and thinning under the protrusion than for the configuration of FIG. 6 because of the earlier engagement of the upper edge of the protrusion 58*a* with the sheet 52 during vacuum forming.

Now referring to FIGS. 12, 13 and 14, a further embodiment of the present invention may be seen. This embodiment illustrates the use of the present invention with respect to panels which simulate conventional wood shake. The individual panels are illustrated in FIG. 12, these panels being characterized by two courses of decorative elements 62 and 64, the courses within any single panel having the appearance of being staggered as with any shake roof installation. Each panel is provided with a plurality of localized projections 66, each within the confines of a simulated shake, and a plurality of recesses 68 at the front thereof, each also being limited in width to well within the confines of a simulated shake. In the particular panel shown, there are three projections and three recesses, with the projections and recesses being equally spaced across the width of the panel. Even with this equal spacing, however, the panels may readily be assembled or installed in a staggered manner, the installation being illustrated in FIG. 13, as each course of panels may be offset one or two positions as desired to tend to break up any otherwise repetitive pattern that would develop up the roof if panels were installed one immediately above another. It is to be understood, of course, that the protrusions 66 as well as the recesses 68 do not need to be equally spaced across the width of the panel, provided however, that the protrusions and recesses of adjacent courses of panels will align as the panels are offset as desired during installation. Further, it should be noted that regardless of the spacing between the protrusions and recesses, the protrusions and recesses in general will not be centered on the respective decorative element, but may well be toward one side of the respective decorative element so that the protrusions and recesses may interlock with the respective adjacent decorative elements having the appearance of substantial staggering.

Other aspects of this embodiment are illustrated in FIG. 14, which is a cross section taken through an installed roof showing a panel 70 with portions of the next lower panel 72 and the next upper panel 74. It may be seen that the protrusion 66 at the rear of each panel is formed almost as a continuation of the upper shake surface, with the bottom part of the protrusion being positioned as high as reasonably possible, at least in vacuum formed parts, to minimize the stretching of the material during the forming of the recess 68. In that regard, if desired the recesses 68 may readily be made wider than the protrusion 66 to allow variations in the relative positions between panels in adjacent courses to further break up any repetitive pattern. Actually, this same effect can tend to create a shadow line under the front of each panel depending upon the relative elevation of the upper part of each recess in conjunction with the top surface of the back of the next lower course of panels, though preferably this should be used only with respect to panels representing a single course of decorative shake, as otherwise the shadow line will not appear between each course of shake in the installed roof.

The thinning encountered in vacuum forming hereinbefore referred to, if not carefully addressed, was found to create a problem at the rear of panels, but not at the front of panels, even if the interlocker extended across the entire width of front of the decorative elements. Consequently, most of the objects of the invention may be realized simply by using protrusions at the back of the decorative elements which do not extend to the edges of the respective decorative elements, and preferably are free of major discontinuities across the width thereof, all without particular regard to the location of the depressions at the front of the decorative elements. Thus, this allows the depressions at the front of a panel, such as the simulated shake panel shown in FIG. 15, to be located at the edge of a decorative element as depression 68*a* is located, or in part extend to an adjacent decorative element such as depression 68*b*, or even be centered between decorative elements such as depression 68*c*. Obviously such locations more readily facilitate staggering of the decorative elements from panel course to panel course, regardless of the decorative element configuration.

One other aspect of the present invention is illustrated in FIG. 14. In particular, as shown in this embodiment a molded foam insert 72 conforming to the inside of the panel is shown within the panel 70. Because of the nature of the panels of the present invention, the foam insert 72, whether used with respect to simulated shake panel 70, simulated tile panels of the previously described embodiment, or panels having other decorative appearances, may be snapped into the panel prior to installation so that a roofer is handling only a single panel assembly rather than attempting to assemble the panel and foam insert on the roof during installation. In particular, as may be seen in FIG. 14, the foam insert 72 is molded with a recess at the front thereof to engage the recess 68 in the panel, with the back of the foam insert having a sufficient protrusion to snap into the recess inside the panel caused by the protrusion 68. Such an insert is highly useful in providing substantial insulation for the roof and further as providing support for the decorative elements to allow the us of thinner materials while still providing sufficient structure for a person to walk on.

There has been described herein new and unique roofing panels which allow the installation thereof without the use of exposed fasteners and which interlock in a simple yet positive manner using an interlocking system which is very easily formed regardless of the production technique used for the fabrication of the panels, and which avoids any water traps which could cause problems in freezing environments. Of course such panels may readily be used for siding also, as they are free of water pockets even when installed on a vertical surface, and otherwise possess all the desirable characteristics of siding. Obviously panels fabricated in accordance with the present invention must be fairly highly ultraviolet light tolerant, though this may be achieved in various ways. In particular, suitable ultraviolet light inhibiting materials are available for injection molding or vacuum forming of the finished part. Alternatively, vacuum formed parts may be formed using a material having a highly ultraviolet light resistive coating or film adhered thereto, such as B F Goodrich Weatherable Capstock or Tedlar film, or as a further alternative the finished panels may be painted with an ultraviolet resistive paint. The ultraviolet resistive film coated plastics are ideal for vacuum forming using the present invention, as the minimization of the stretching of the material in accordance with the present invention also minimizes the extent of stretching of the film during forming, maintaining the maximum integrity of the film for the intended purpose.

Obviously, while the present invention has been disclosed and described with respect to certain preferred embodiments thereof, it will be understood by those skilled in the art that various changes in form and detail may be made therein without departing from the spirit and scope thereof.

I claim:

1. A panel having decorative elements, and adapted to interfit with similar panels when installed, comprising a background sheet means vacuum formed to have;

at least one decorative element means extending upward from said background sheet means and integrally formed therewith, each said decorative element means having first and second ends, said first end being adjacent said front of said sheet means, and said second end being adjacent said rear of said sheet means, said first end of at least one of said decorative element means having an integrally formed recess therein;

said second end of at least one of said decorative element means having an integrally formed protrusion therein extending over less than the width of said second end of the respective said decorative element means so as to not intersect the edges thereof, said protrusion extending over said background sheet means and having a lower surface substantially parallel to and displaced from said background sheet means;

said protrusion and said recess being cooperatively proportioned whereby when said panel is installed with similar panels in a plurality of courses of panels, the protrusion on said second end of at least one of said decorative element means of one panel may extend into the recess on said first end of at least one of said decorative element means of the panel in the next course thereabove to interlock courses of panels together.

2. The panel of claim 1 wherein said protrusion has a cros sections in vertical planes through the respective decorative element means which are substantially free of discontinuities in cross section as the vertical plane is moved across said recess and said protrusion.

3. The panel of claim 1 wherein said protrusion is faired gradually from its position of maximum extent to blend substantially smoothly into the first and second ends of the respective said at least one decorative element means as viewed from above said background sheet means.

4. The panel of claim 1 wherein said decorative element means simulate at least one course of ceramic tile.

5. The panel of claim 1 wherein said decorative element means simulates at least one course of wood shake.

6. The panel of claim 1 wherein said panel comprises a sheet of thermoplastic material with the top surface thereof having an ultraviolet light resistive film adhered thereto.

7. The panel of claim 1 further comprised of a molded insulative filler conforming in substantial part to the interior of said panel under said decorative element means.

8. The panel of claim 7 wherein said filler is retained in said panel by engagement between said filler, and said recess and said protrusion on said panel.

9. The panel of claim 1 having a foam member substantially filling the region under said at least one decorative element.

10. The panel of claim 9 wherein said foam member is a snap in foam member.

11. The panel of claim 1 wherein the lower surface of said recess is substantially parallel to said background sheet means.

12. The panel of claim 11 wherein the lower surfaces of said recess and said protrusion are each elevated from said background sheet in a amount equal to a substantial part of the height of the adjacent decorative element means on which said recess and said protrusion are formed.

13. The panel of claim 11 wherein the lower surface of said protrusion is elevated from said background sheet by approximately fifty percent of the height of said second end of the respective decorative element means.

14. The panel of claim 1 wherein the rear of said background sheet means extends beyond said protrusion to define a flange through which the rear of a panel may be fastened down, and to define a moisture barrier which will extend under the front of the corresponding panel or panels in the next course of panels.

15. The panel of claim 14 wherein the side regions of said panel are cooperatively configured so that the side region adjacent the first side of one panel will fit over the side region adjacent the second side of a similar panel therebeside to form a moisture barrier between adjacent panels within the same course of panels.

16. The panel of claim 15 wherein the side region adjacent the first side has the visual appearance of part of said at least one decorative element means whereby adjacent panels in a course of panels appear as a continuous pattern of decorative element means.

17. A panel having decorative elements, and adapted to interfit with similar panels when installed, comprising:

a background sheet of thermoplastic material having front, rear and first and second side edges, and having a film of ultraviolet radiation resistant material adhered to the top surface thereof, said background sheet being vacuum formed to have:

at least one decorative element means formed upward from said background sheet means and integrally formed therewith, each said decorative element means having first and second ends between said front edge and said rear edge of said sheet means, said first end of at least one of said decorative element means having an integrally formed recess therein extending over less than the width of said first end of the respective said decorative element means so as to not intersect the edges thereof, said second end of at least one of said decorative element means having an integrally formed protrusion therein extending over less than the width of said second end of the respective said decorative element means so as to not intersect the edges thereof, said protrusion extending over said background sheet means and having a lower surface substantially parallel to and displaced from said background sheet means;

said protrusion and said recess being cooperatively proportioned whereby when said panel is installed with similar panels in a plurality of courses of panels, the protrusion on one end of at least one of said decorative element means of one panel may extend into the recess on the other end of at least one of said decorative element means of the panel in another course to interlock courses of panels together.

18. The panel of claim 17 wherein said recess and said protrusion each have cross sections in vertical planes through the respective decorative element means which are substantially free of discontinuities in cross section as the vertical plane is moved across said recess and said protrusion.

19. The panel of claim 17 wherein said recess and said protrusion each are paired gradually from their positions of maximum extent to blend substantially smoothly into the first and second ends of the respective said at least one decorative element means as viewed from above said background sheet means.

20. The panel of claim 17 herein said decorative element means simulate at least one course of ceramic tile.

21. The panel of claim 17 wherein said decorative element means simulates at least one course of wood shake.

22. The panel of claim 17 is further comprised of a molded insulative filler conforming in substantial part to the interior of said panel under said decorative element means.

23. The panel of claim 22 wherein said filler is released in said panel by engagement between said filler, and said recess and said protrusion on said panel.

24. The panel of claim 17 having a foam member substantially filling the region under said at least one decorative element means.

25. The panel of claim 24 wherein said foam member is a snap in foam member.

26. The panel of claim 17 wherein the lower surface of said recess and said protrusion are substantially parallel to said background sheet means.

27. The panel of claim 26 wherein the lower surfaces of said recess and said protrusion are each elevated from said background sheet in an amount equal to a substantial part of the height of the adjacent decorative element means on which said recess and said protrusion are formed.

28. The panel of claim 17 wherein said rear edge of said background sheet means extends beyond said protrusion to define a flange through which the rear of a panel may be fastened down, and to define a moisture barrier which will extend under the front of the corresponding panel or panels in the next course of panels.

29. The panel of claim 28 wherein the side regions of said panel adjacent said first and second side edges are cooperatively configured so that the side region adjacent the first side edge of one panel will fit over the side region adjacent the second side edge of a similar panel therebeside to form a moisture barrier between adjacent panels within the same course of panels.

30. The panel of claim 29 wherein the side region adjacent the first side edge has the visual appearance of part of said at least one decorative element means whereby adjacent panels in a course of panels appear as a continuous pattern of decorative element means.

31. In plurality, panels having decorative elements, and adapted to interfit with each other when installed, each said panel comprising:

a background sheet of thermoplastic material having front, rear and first and second side edges, and having a film of ultraviolet radiation resistant material adhered to the top surface thereof, said background sheet being vacuum formed to have:

a plurality of decorative element means formed upward from said background sheet means and integrally formed therewith to stimulate at least one course of elements, each said decorative element means having first and second ends, said first end being adjacent said front edge of said sheet means, and said second end being adjacent said rear edge of said sheet means, said first end of at least one of said decorative element means having an integrally formed recess therein extending over less than the width of said first end of the respective said decorative element means so as to not intersect the edges thereof, said protrusion extending over said background sheet means and having a lower surface substantially parallel to and displaced from said background sheet means;

said second end of at least one of said decorative element means having an integrally formed protrusion therein extending over less than the width of said second end of the respective said decorative element means so as to not intersect the edges thereof;

said protrusion and said recess being cooperatively proportioned whereby when said panels are installed in a plurality of courses of panels, the protrusion on said second end of at least one of said decorative element means of one panel may extend into the recesss on said first end of at least one of said decorative element means of the panel in the next course thereabove to interlock courses of panels together.

32. The panel of claim 31 wherein said recess and said protrusion each have cross sections in vertical planes through the respective decorative element means which are substantially free of discontinuities in cross section as the vertical plane is moved across said recess and said protrusion.

33. The panel of claim 31 wherein said recess and said protrusion each are paired gradually from their positions of maximum extent to blend substantially smoothly into the first and second ends of the respective said at least one decorative element means as viewed from above said background sheet means.

34. The panel of claim 31 wherein said decorative element means simulate at least one course of ceramic tile.

35. The panel of claim 31 wherein said decorative element means simulates at least one course of wood shake.

36. The panels of claim 31 further including starter panels for use in a starter course of panels, each starter panel having a plurality of decorative elements, each having a decorative first end, and otherwise each being the same as each of said panels.

37. The panel of claim 31 is further comprised of a molded insulative filler conforming in substantial part to the interior of said panel under said decorative element means.

38. The panel of claim 37 wherein said filler is released in said panel by engagement between said filler and said recess and said protrusion on said panel.

39. The panel of claim 31 having a foam member substantially filling the region under said at least one decorative element means.

40. The panel of claim 39 wherein said foam member is a snap in foam member.

41. The panel of claim 31 wherein the lower surface of said recess and said protrusion are substantially parallel to said background sheet means.

42. The panel of claim 41 wherein the lower surfaces of said recess and said protrusion are each elevated from said background sheet in an amount equal to a substantial part of the height of the adjacent decorative element means on which said recess and said protrusion are formed.

43. The panels of claim 31 wherein said rear edge of said background sheet means extends beyond said protrusion to define a flange through which the rear of a panel may be fastened down, and to define a moisture barrier which will extend under the front of the corresponding panel or panels in the next course of panels.

44. The panels of claim 43 wherein the side regions of said panel adjacent said first and second side edges are cooperatively configured so that the side region adjacent the first side edge of one panel will fit over the side region adjacent the second side edge of a similar panel therebeside to form a moisture barrier between adjacent panels within the same course of panels.

45. The panel of claim 44 wherein the side region adjacent the first side edge has the visual appearance of part of said at least one decorative element means whereby adjacent panels in a course of panels appear as a continuous pattern of decorative element means.

46. A panel having decorative elements, and adapted to interfit with similar panels when installed, comprising:

a background sheet means;

at least one decorative element means extending upward from said background sheet means and integrally formed therewith, each said decorative element means having first and second ends, said first end being adjacent said front of said sheet means, and said second end being adjacent said rear of said sheet means, said first end of at least one of said decorative element means having an integrally formed recess therein extending over less than the width of said first end of the respective said decorative element means so as to not intersect the edges thereof:

said second end of at least one of said decorative element means having an integrally formed protrusion therein extending over less than the width of said second end of the respective said decorative element means so as to not intersect the edges thereof;

said protrusion and said recess being cooperatively proportioned whereby when said panel is installed with similar panels in a plurality of courses of panels, the protrusion on said second end of at least one of said decorative element means of one panel may extend into the recess on said first end of at least one of said decorative element means of the panel in the next course thereabove to interlock courses of panels together.

47. The panel of claim 46 wherein said recess and said protrusion each have cros sections in vertical planes through the respective decorative element means which are subtantially free of discontinuities in cross section as the vertical plane is moved across said recess and said protrusion.

48. The panel of claim 46 wherein said recess and said protrusion each are faired gradually from their positions of maximum extent to blend substantially smoothly into the first and second ends of the respective said at least one decorative element means as viewed from above said background sheet means.

49. The panel of claim 46 wherein the rear of said background sheet means extends beyond said protrusion to define a flange through which the rear of a panel may be fastened down, and to define a moisture barrier which will extend under the front of the corresponding panel or panels in the next course of panels.

50. The panel of claim 49 wherein the side regions of said panel are cooperatively configured so that the side region adjacent the first side of one panel will fit over the side region adjacent the second side of similar panel therebeside to form a moisture barrier between adjacent panels within the same course of panels.

51. The panel of claim 50 wherein the side region adjacent the first side has the visual appearance of part of said at least one decorative element means whereby adjacent panels in a course of panels appear as a continuous pattern of decorative element means.

* * * * *